US005222934A

United States Patent [19]

Öchsner

[11] Patent Number: 5,222,934

[45] Date of Patent: Jun. 29, 1993

[54] SIGNATURE CONVEYING ASSEMBLY

[75] Inventor: Rudolf P. Öchsner, Beindersheim, Fed. Rep. of Germany

[73] Assignee: Albert-Frankenthal Aktiengesellschaft, Wurzburg, Fed. Rep. of Germany

[21] Appl. No.: 880,008

[22] Filed: May 8, 1992

[30] Foreign Application Priority Data

May 10, 1991 [DE] Fed. Rep. of Germany ..... 4115238
May 24, 1991 [DE] Fed. Rep. of Germany ..... 4116992

[51] Int. Cl.[5] ..... B65H 45/18
[52] U.S. Cl. ..... 493/444; 493/437
[58] Field of Search ..... 493/424, 434, 435, 437, 493/444, 445; 271/229, 198, 233, 245, 272, 273

[56] References Cited

U.S. PATENT DOCUMENTS 2,711,317 6/1955 Maupin ..... 493/445
4,175,740 11/1979 Klenk ..... 493/435
4,338,088 7/1982 Buss ..... 493/445
4,549,728 10/1985 Odeau .
4,746,108 5/1988 Hirayama ..... 493/437

FOREIGN PATENT DOCUMENTS 2546818 6/1983 France .
976121 2/1954 Fed. Rep. of Germany .
3239799 10/1982 Fed. Rep. of Germany .

*Primary Examiner*—Bruce M. Kisliuk
*Assistant Examiner*—Jack Lavinder
*Attorney, Agent, or Firm*—Jones, Tullar & Cooper

[57] ABSTRACT

A signature conveying assembly for a longitudinal folder of a web-fed rotary printing press utilizes a horizontally adjustable belt support roll to vary the intensity of the clamping force of the belts against the conveyed signatures and the impact force of the signatures against a stop.

4 Claims, 2 Drawing Sheets

SIGNATURE CONVEYING ASSEMBLY

FIELD OF THE INVENTION

The present invention is directed generally to a signature conveying device. More particularly, the present invention is directed to a signature conveying device in a folder of a web-fed rotary press. Most specifically, the present invention is directed to a device for the transportation of signatures in a longitudinal folding direction between spaced upper and lower conveyor belts. The signatures are transported by the conveyor belts along a folding table to a folding blade. The signatures are carried into abutting engagement with a stop at the end of the folding table by the spaced conveying belts. The angle of separation between the upper and lower belts in the area of the folding table can be varied to change the clamping force applied to the signatures.

DESCRIPTION OF THE PRIOR ART

Signature folding devices and assemblies for conveying signatures to be folded to the folding devices are generally known in the art. In these prior devices, it is typical to convey the signatures to the folding area by spaced signature engaging belts. The signatures are conveyed by the belts to a position beneath a generally vertically reciprocating folding blade. This blade engages the signature to be folded and pushes it downwardly into the folding nip formed by two spaced, generally parallel folding rollers. One such prior art signature conveying and folding assembly is shown in German patent specification No. 32 39 799. This specification shows spaced upper and lower signature conveying belts that move the signatures to be folded into position beneath a folding blade that urges the signatures being folded into engagement with a pair of spaced rollers.

These prior art signature conveying assemblies have not provided a way to adjust the impact intensity of the signature being conveyed against a stop that is often located at the end of the folding table. They have also been apt to smear the freshly printed signatures due to the relative movement between the conveying belts and the signature in the folding area.

It will thus be apparent that a need exists for a signature conveying assembly which overcomes the limitations of the prior art devices. The signature conveying assembly of the present invention provides such a device and is a significant improvement over the prior art devices.

SUMMARY OF THE INVENTION

It is an object of the present invention to provide a signature conveying assembly.

Another object of the present invention is to provide a signature conveying device in a folder of a web-fed rotary press.

A further object of the present invention is to provide a device for the transportation of signatures in a longitudinal folding device between spaced upper and lower belts.

Yet another object of the present invention is to provide a signature conveying assembly for a longitudinal folding device in which the impact intensity of the signatures to be longitudinally folded can be influenced at a stop.

Still a further object of the present invention is to provide a signature conveying assembly having diverging upper and lower conveying belts in which the angle of divergence is variable.

As will be discussed in detail in the description of the preferred embodiment which is set forth subsequently, the signature conveying assembly of the present invention utilizes a plurality of upper driven conveyor belts, together with a plurality of lower driven conveyor belts to convey signatures carried between the upper and lower belts to a folding position beneath a vertically reciprocable folding blade. As the signatures to be folded are carried beneath the folding blade, their leading ends abut a stop. In accordance with the present invention, the angle of declination between the upper conveying belts and the lower conveying belts can be varied by movement of a lower conveying belt support roller and spindle in the direction of signature folding. Varying this angle results in a change in the intensity of the impact of the signature end against the stop and also in the clamping force between the belts and the signatures.

The signature conveying assembly of the present invention overcomes the limitation of the prior art devices by providing an assembly in which the clamping force between the upper and lower belts and the signatures being conveyed to the folding table can be controlled. This allows the impact force of the sheets against the stop to be adjusted in accordance with signature thickness and weight. It also eliminates slippage between the signatures and the conveying belts so that smearing of the signatures by the conveying belts in the folding areas is avoided.

It will thus be seen that the signature conveying assembly of the present invention overcomes the limitations of the prior art devices and is a substantial advance in the art.

BRIEF DESCRIPTION OF THE DRAWINGS

While the novel features of the signature conveying assembly of the present invention are set forth with particularity in the appended claims, a full and complete understanding of the invention may be had by referring to the detailed description of the preferred embodiment which is set forth subsequently, and as illustrated in the accompanying drawings in which:

DESCRIPTION OF THE PREFERRED EMBODIMENT

Figure 1:
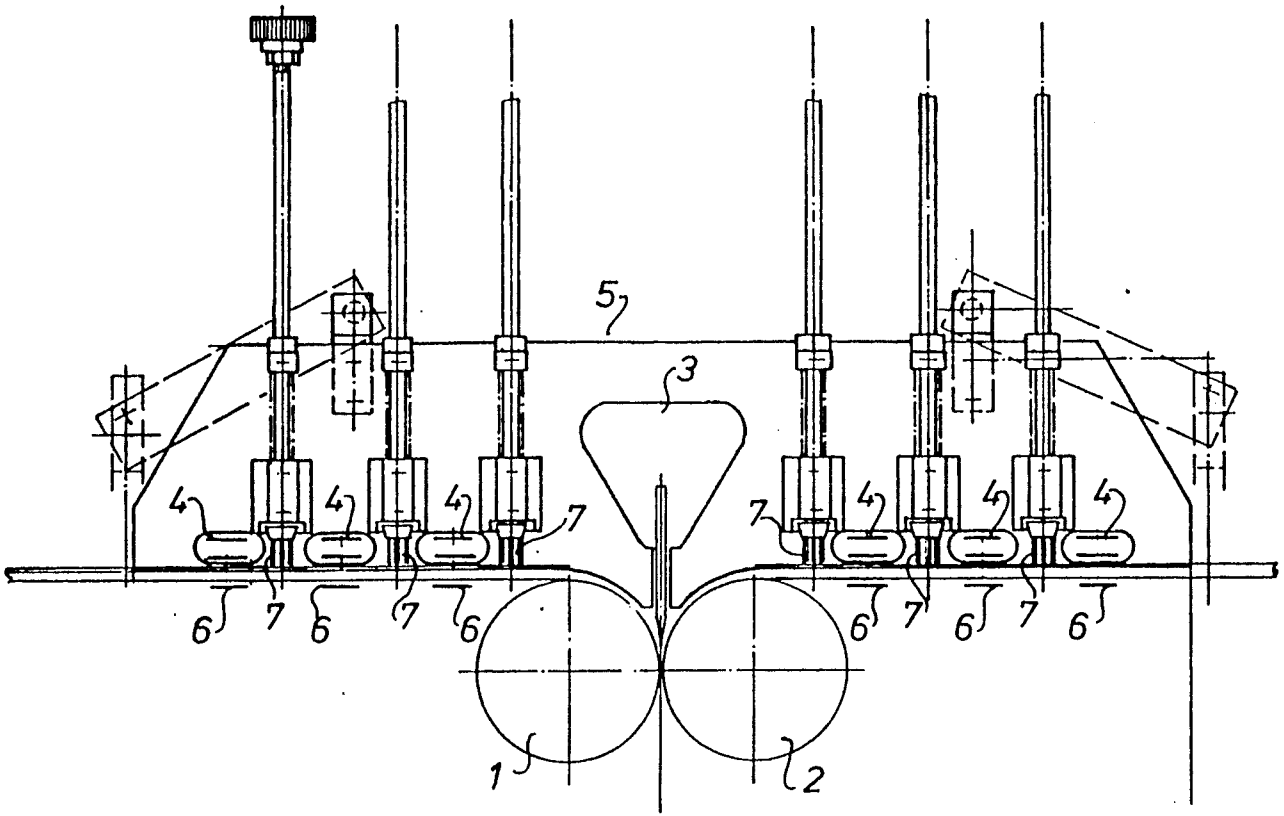
FIG. 1 is an end view of the longitudinal folding device employing the signature conveying assembly of the present invention looking in the direction of signature transport toward the folding blade.
Figure 2:
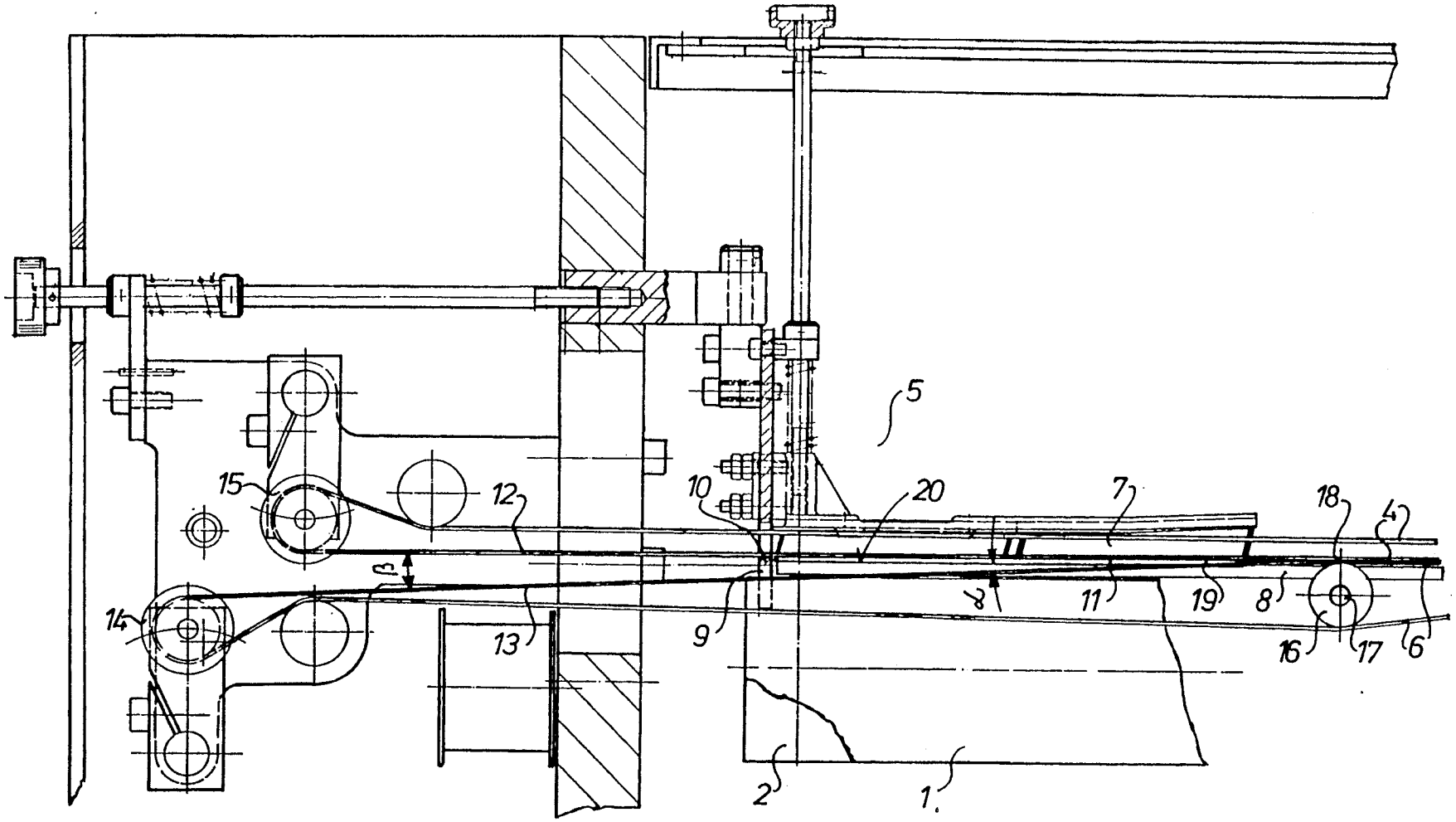
FIG. 2 is a side elevation view of the longitudinal folding device and the signature conveying assembly of the present invention with the longitudinal folding blade removed for clarity.

Referring initially to FIG. 1, there may be seen a longitudinal folding device, generally at 5, in which the signature conveying assembly of the present invention is utilized. A pair of generally parallel driven folding rollers 1 and 2, which form a folding roller pair, are positioned beneath a longitudinal folding blade 3. This longitudinal folding blade 3 moves generally in a rhythmical up and down motion to direct a portion of a signature into the nip between the folding roller pair to thereby form a longitudinal fold in a signature 11 which, as may be seen in FIG. 2 is positioned atop a folding table 8 that is provided with a central longitudinal aperture. A plurality of spaced upper driven conveyor belts 4 and a cooperating plurality of spaced lower driven conveyor belts 6 move the signatures into position on the folding table 8 beneath the folding blade 3. A plurality of press-on brushes 7 cooperate with the upper driven conveyor belts 4 to hold the signatures in place. A stop 9, which may be seen most clearly in FIG. 2, is placed at the downstream end of the folding table 8. The signatures 11 to be folded are brought by the signature conveying assembly into abutting engagement with the stop 9 and are brought to rest for a brief moment before they are longitudinally folded by the folding blade 3.

Referring now primarily to FIG. 2, the signatures 11 to be folded are transported between a lower transporting belt side 12 of the upper conveyor belts 4 and an upper transporting belt side 13 of the lower conveyor belts 6 until the signatures 11 impact against the stop 9. When this happens, the longitudinal folding blade 3 comes down from above and presses the signature 11 into the nip or folding gap between the two driven folding rollers 1 and 2. The lower transporting belt surface 12 of the upper conveying belts 4 move, at least in principle, along the upper surface 20 of the folding table 8 slightly above the upper surface 20 and generally parallel to the surface 20. These belts 12 may even have a slight angle of ascent, generally in the order of 0.5°-1.5° with respect to the surface 20 of the folding table 8. The lower transporting belt sides 12 of the upper conveying belts 4 are, in the absence of an interposed signature 11, in surface contact with the upper transporting belt sides 13 of the lower conveyor belts 6.

The upper transporting belt sides 13 of the lower conveying belts 6 pass through slots or spaces in the folding table and are supported by belt rolls 16. These belt rolls 16 are longitudinally shiftable, either individually or jointly, in the direction of, or against the direction of travel of the conveyed signatures 11. This is accomplished by rotatably supporting the belt rolls 16 on spindles 17 which are carried in guide slots or other suitable guides which are secured to the frame of the folding device. Thus each spindle 17 is shiftable in the horizontal direction in or against the sheet transport direction of the signatures.

The upper conveyor belts 4 pass around a frame attached idler roller 15 while the lower conveyor belts 6 pass around a frame attached idler roller 14. As may be seen in FIG. 2, the upper transporting belt sides 13 of the lower conveyor belts 6 are directed downwardly and toward the rear frame fixed idler roller 14 at an angle of declination of generally about 2°-3° with respect to the surface 20 of the folding table 8. The upstream portion of the upper transporting belt sides 13 of the lower conveyor belts 6 are supported at their maximum height by the belt rolls 16 at the infeed end of the folding table 8. These belt rolls 16 are shiftable in opposition to the direction of signature transport until they are at the end 18 of the maximum width of a signature 11 that is supported on the folding table 8. The belt rolls 16 can then be shifted generally horizontally in a downstream direction toward the stop 9. Any movement of the belt rolls 16 away from their maximum upstream position 18 will increase the angle of declination $\alpha$ of the upper transporting belt sides 13 with respect to the upper surface 20 of the horizontal folding table 8.

The somewhat triangular area 19 between the lower surface 12 of the upper belts 4 and the upper surface 13 of the lower belts 6 which extends from the belt rolls 16 to the idler rolls 14 and 15 is categorized as a delivery spandrel. As the belt rolls 16 are moved toward the signature stop 9 the signatures 11 immerses longer in this delivery spandrel 19. This causes the clamping force applied to the signatures 11 by the upper and lower transporting belt sides 12 and 13 to become more intense. This increased intensity of clamping force also increases the intensity of the impact force of the signatures against the stop 9.

The ability of the signature conveying assembly of the present invention to accommodate various signatures having differing weights and paper thicknesses is provided by the ability to vary the intensity of the contact of the conveyor belts 4 and 6 with the top and bottom surfaces of the signatures 11. The ability to vary the angle $\beta$ of the delivery spandrel 19 and the ability to vary the prolongation of the delivery spandrel 19 in the direction of the stop 9 allows the signature conveying assembly of the present invention to accommodate a wide range of signature thicknesses and papers.

The upper conveyor belts 4 are spaced from the upper surface 20 of the folding table 8 when they pass through the stop 9. In a similar manner, the lower conveyor belts 6 slope down and away from the folding table 8 in the area of the signature stop 9. This allows the signature impact face of the stop 9 to be enlarged. Accordingly, the increased signature impact forces that can be generated by the signature conveying assembly of the present invention as a result of the ability to vary the angle $\beta$ of the delivery spandrel 19 as well as its prolongation will not have a harmful effect on the stop 9.

While a preferred embodiment of a signature conveying assembly in accordance with the present invention has been set forth fully and completely hereinabove, it will be apparent to one of skill in the art that a number of changes in, for example, the number of upper and lower conveying belts, the means for driving the folding blade, the structure of the folding rollers and the like could be made without departing from the true spirit and scope of the subject invention which is accordingly to be limited only by the following claims.

What is claimed is:

1. A signature conveying and folding assembly which is usable to transport and fold signatures in a longitudinal folding device in a printing press, said signature conveying and folding assembly comprising:

a folding table having an upper, signature support surface;

a signature stop positioned at a downstream end of said folding table;

a vertically reciprocable folding blade which engages said signatures on said folding table;

a pair of spaced folding follers positioned beneath said folding table and folding said signatures delivered to said folding rollers by said folding blade;

a plurality of spaced upper conveying belts having lower signature transporting belt sides, said lower signature transporting belt sides being supported above, and generally parallel to said upper signature support surface of said folding table;

a plurality of spaced lower conveying belts having upper signature transporting belt sides, said upper signature transporting belt sides passing downwardly through said folding table at an angle of declination in a direction of transport of said signatures; and a delivery spandrel defined by said upper and lower signature transporting belt sides of said lower and upper conveying belts in the area of said folding table, said delivery spandrel having a generally triangular area, whereby said signatures are conveyed by contact with said upper and lower conveying belts with a clamping force that decreases in said delivery spandrel in said direction of transport of said signatures toward said signature stop.

2. The signature conveying assembly of claim 1 wherein said delivery spandrel is variably positionable.

3. The signature conveying assembly of claim 1 further including at least one shiftable belt roll, said belt roll being in contact with said upper signature transporting belt sides of said lower conveying belts.

4. The signature conveying assembly of claim 1 wherein said signature stop has a signature stop and impact face between said lower signature transporting belt side and said upper surface of said folding table.

* * * * *